US008925773B2

(12) United States Patent
Clifton

(10) Patent No.: US 8,925,773 B2
(45) Date of Patent: Jan. 6, 2015

(54) HOLSTER ASSEMBLY FOR A REVOLVER AND RELATED LOCKING DEVICE

(75) Inventor: Norman E. Clifton, Jacksonville, FL (US)

(73) Assignee: Salariland, LLC, Jacksonville, FL (US)

( * ) Notice: Subject to any disclaimer, the term of this patent is extended or adjusted under 35 U.S.C. 154(b) by 590 days.

(21) Appl. No.: 13/009,986

(22) Filed: Jan. 20, 2011

(65) Prior Publication Data

US 2011/0174850 A1 Jul. 21, 2011

Related U.S. Application Data

(60) Provisional application No. 61/296,513, filed on Jan. 20, 2010.

(51) Int. Cl.
*F41C 33/02* (2006.01)
*F41C 33/00* (2006.01)

(52) U.S. Cl.
CPC ..... *F41C 33/0209* (2013.01); *F41C 33/0263* (2013.01)
USPC ..... 224/243; 224/238; 224/192; 224/193; 224/198; D2/222

(58) Field of Classification Search
USPC ..... 224/243, 238, 192, 193, 198; D2/222
See application file for complete search history.

(56) References Cited

U.S. PATENT DOCUMENTS

| | | | | |
|---|---|---|---|---|
| 6,732,891 | B2 * | 5/2004 | Locklear, III | 224/244 |
| 7,584,875 | B2 * | 9/2009 | Lowe et al. | 224/243 |
| 7,922,050 | B2 * | 4/2011 | Beneš | 224/244 |
| 8,052,018 | B2 * | 11/2011 | Gallagher | 224/243 |
| 2002/0134803 | A1 * | 9/2002 | Lowe et al. | 224/243 |
| 2004/0050887 | A1 * | 3/2004 | Spielberger | 224/244 |
| 2006/0226185 | A1 * | 10/2006 | Har-Shen | 224/244 |
| 2008/0121670 | A1 * | 5/2008 | Buress | 224/243 |
| 2009/0294496 | A1 * | 12/2009 | Gallagher | 224/243 |

* cited by examiner

*Primary Examiner* — Brian D Nash
*Assistant Examiner* — Derek Battisti
(74) *Attorney, Agent, or Firm* — Arthur G. Yeager

(57) ABSTRACT

A holster assembly for a revolver includes a holster pocket for removably accommodating a revolver therein, the holster pocket generally surrounding an insertion axis of the revolver, and a locking device arranged in the holster pocket for automatically engaging the revolver upon insertion into the holster pocket and selectively operable to allow subsequent removal of the revolver.

20 Claims, 5 Drawing Sheets

HOLSTER ASSEMBLY FOR A REVOLVER AND RELATED LOCKING DEVICE

CROSS-REFERENCE TO RELATED APPLICATION

This application claims the benefit of U.S. Provisional Application Ser. No. 61/296,513, filed on Jan. 20, 2010, the contents of which are herein incorporated by reference in their entirety.

FIELD OF THE INVENTION

The present invention relates to firearm holsters, and more particularly, to holster assemblies with locking devices for revolvers.

BACKGROUND OF THE INVENTION

It is known to equip firearm holsters with locking devices that help prevent unwanted and/or unauthorized withdrawal of the firearm. One locking device includes a saddle with engagement protrusions that is automatically biased into engagement with suitable surfaces of the firearm to inhibit withdrawal. The locking device includes an operating lever that extends out the holster and is operable to disengage the protrusions and allow firearm withdrawal. An example of this locking device can be seen in U.S. Pat. No. 7,694,860, dated Apr. 13, 2010, the contents of which are hereby incorporated by reference in their entirety. This type of locking device has proven very serviceable. However, additional developments and improvements are possible.

SUMMARY OF THE INVENTION

In view of the foregoing, it is an object of the present invention to provide an improved holster assembly. In particular, it is an object of the present invention to provide a holster assembly with a locking device for a revolver.

According to an embodiment of the present invention, a holster assembly includes a holster pocket with a locking device arranged therein and configured to accommodate insertion of a revolver, the locking device including a body and a operating lever pivotally mounted thereto. The operating lever is pivotable between a locked position, in which an engagement leg of the operating lever is in the path of a revolver cylinder, and an unlocked position, in which the operating lever is clear of the path of the revolver cylinder.

These and other objects, aspects and advantages of the present invention will be better appreciated in view of the drawings and following detailed description of a preferred embodiment.

DETAILED DESCRIPTION OF A PREFERRED EMBODIMENT

Figure 1:
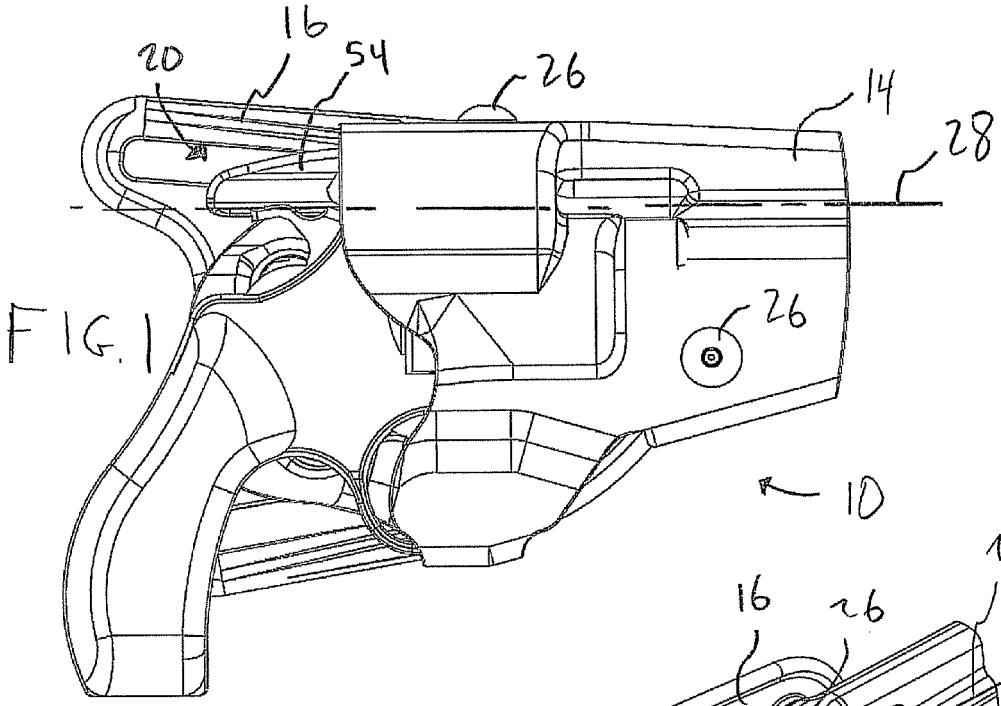
FIG. 1 is a side view of a holster assembly for a revolver according to an embodiment of the present invention, including a holster pocket and locking device, with the revolver inserted therein.
Figure 2:
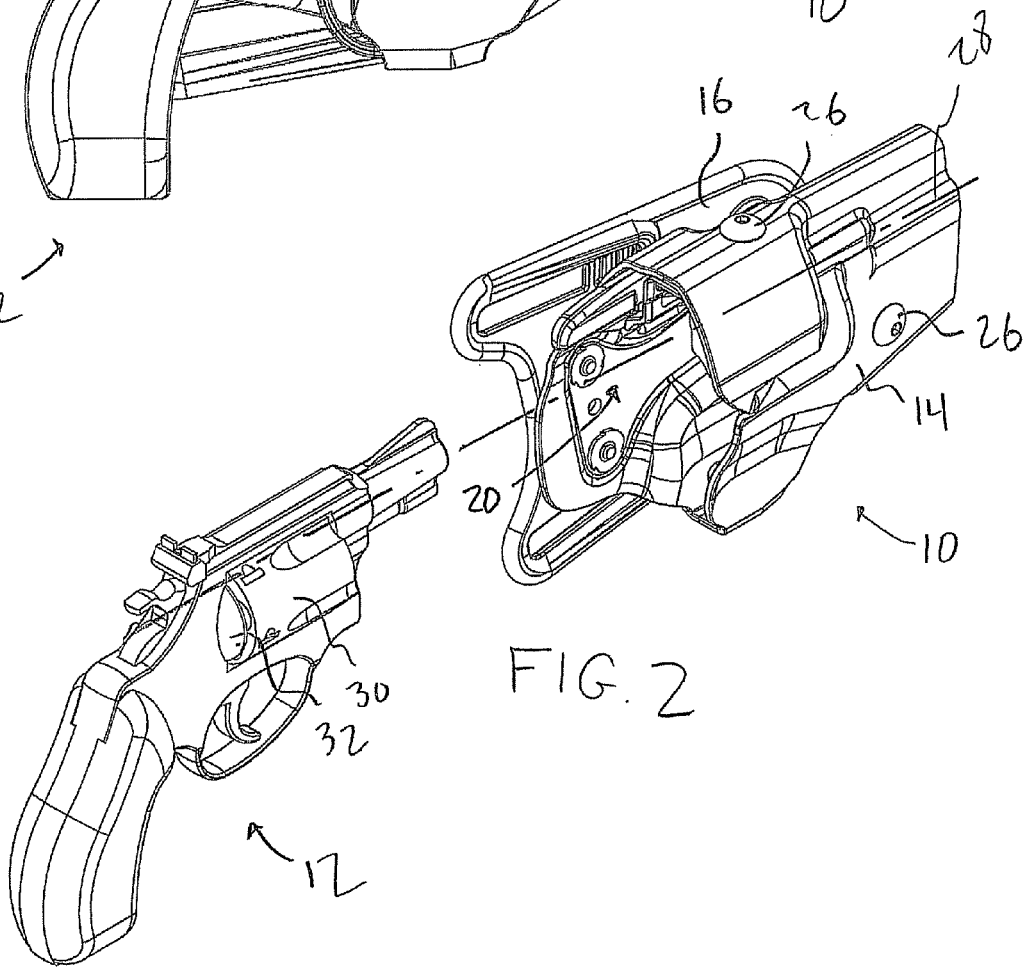
FIG. 2 is a perspective view of the holster assembly of FIG. 1, with the revolver withdrawn.
Figure 3:
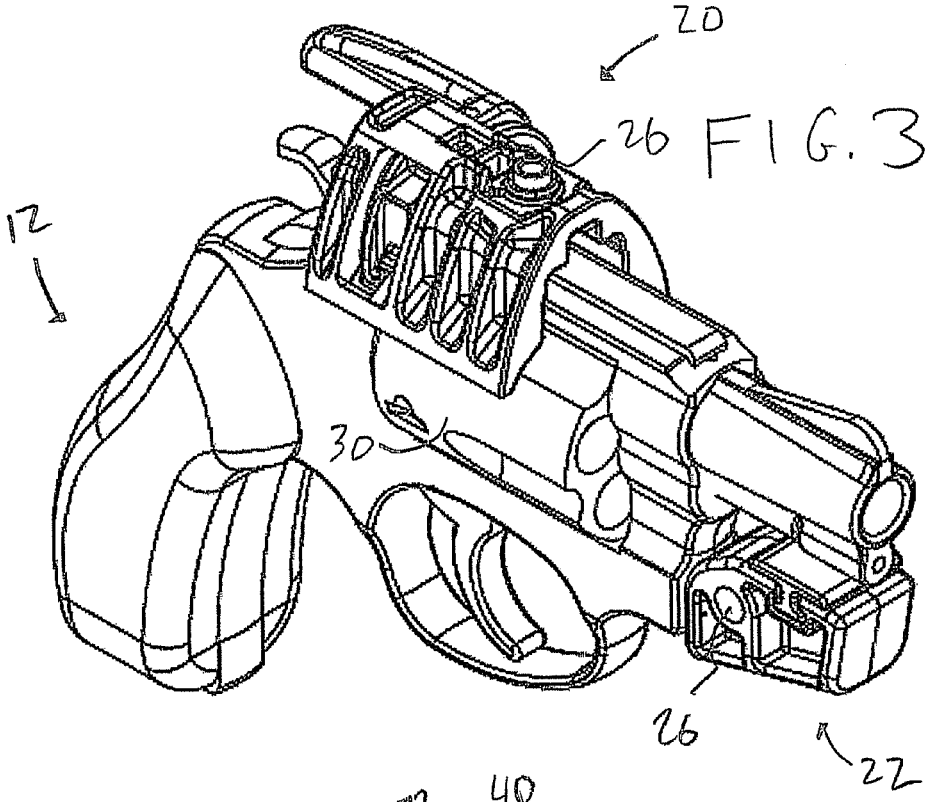
FIG. 3 is a perspective view of the holster assembly of FIG. 1, with the holster pocket removed to show additional details of the locking device and a barrel positioning block assembly.

Referring to FIGS. 1-3, a holster assembly 10 for a revolver 12 includes a holster pocket 14, a belt attachment plate 16, a locking device 20 and a barrel positioning block assembly 22. The belt attachment plate 16, locking device 20 and barrel positioning block assembly 22 are releasably secured in the holster pocket 14 by a plurality of fastener elements 26, for instance machine screws and corresponding threaded anchors. The holster pocket 14 and locking device 20 generally extend along an insertion axis 28 of the revolver 12.

The holster pocket 14 is preferably a rigidly molded structure dimensioned to generally conform to the portion of the revolver 12 inserted therein.

The belt attachment plate 16 allows releasable mounting of the holster assembly 10 to a belt, harness or other connection point on a revolver user. The belt attachment plate 16, as well as the rest of the holster assembly 10, are adapted for a right-hand draw arrangement. It will be appreciated that a left-handed draw arrangement is readily achieved using a mirror image of the holster assembly 10.

The locking device 20 is configured to automatically engage the revolver 12 upon insertion into the holster pocket 14 to inhibit withdrawal and is selectively operable to allow subsequent removal of the revolver 12. More particularly, the locking device 20 is configured to automatically engage the cylinder 30 and/or the associated cylinder guard or load gate 32 (referred to generally as cylinder guard 32).

The barrel positioning block assembly 22 is adapted to limit insertion of the revolver 12 into the holster pocket 14 and facilitate proper alignment between the revolver 12 and the locking device 20.

Figure 4:
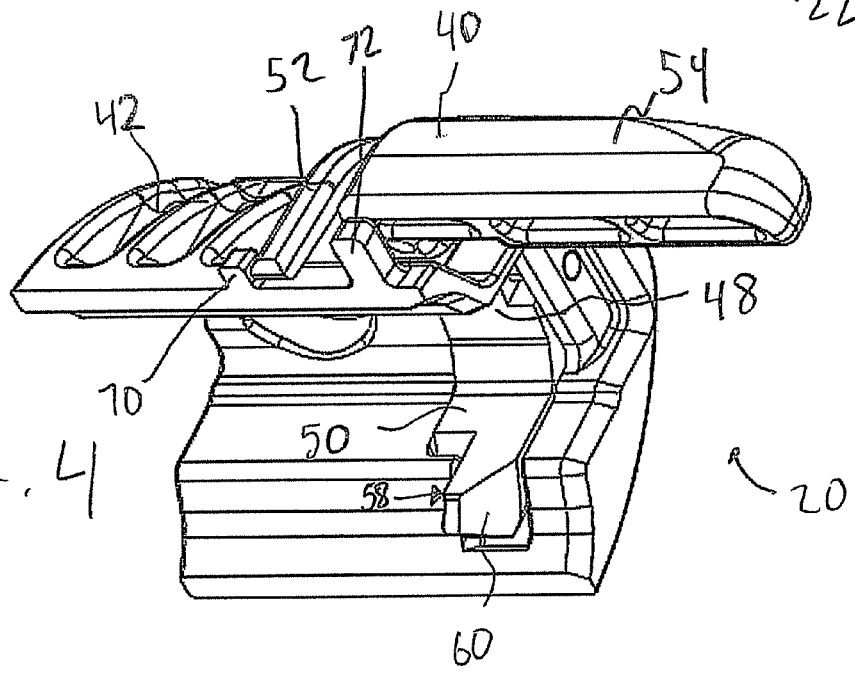
FIG. 4 is a perspective view of the locking device of FIG. 1.
Figure 5:
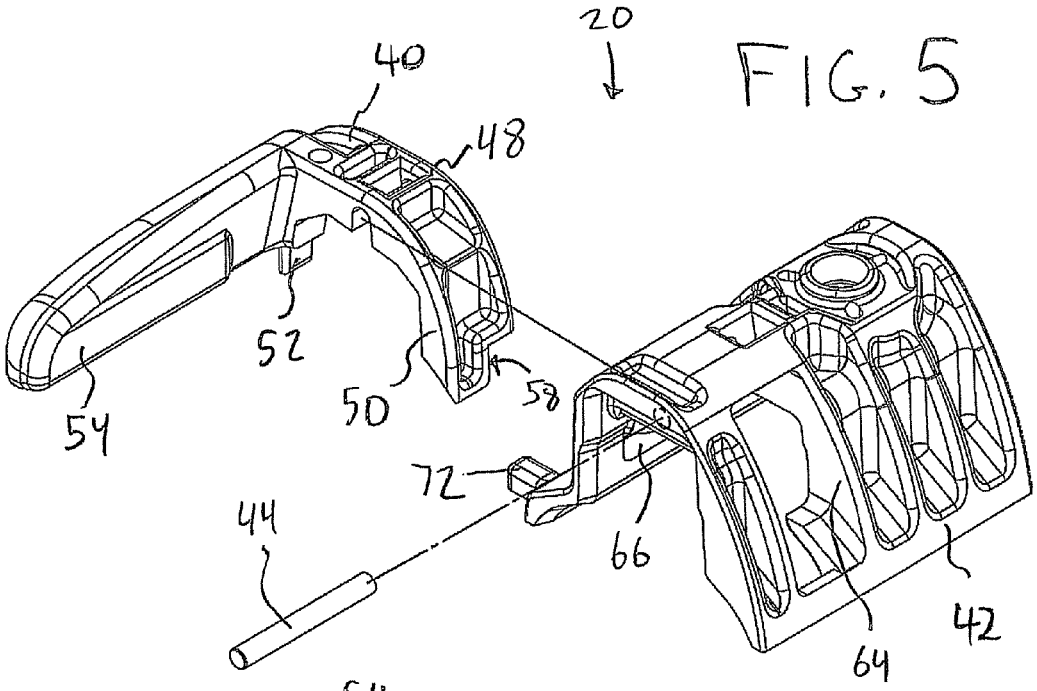
FIG. 5 is an exploded perspective view of the locking device of FIG. 1.
Figure 6:
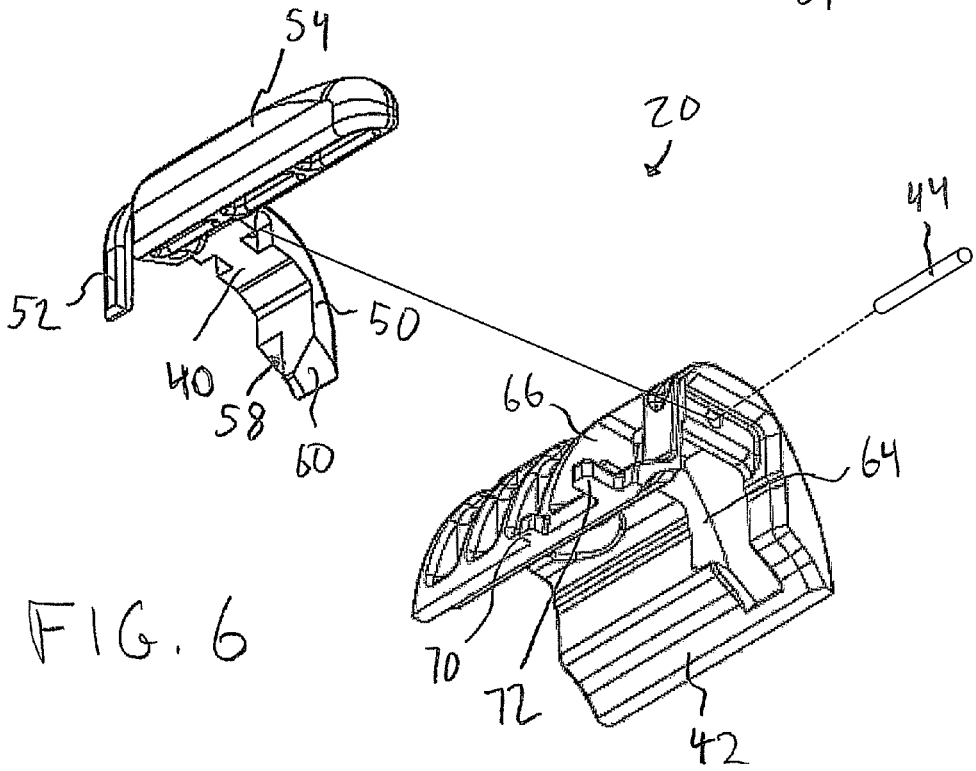
FIG. 6 is another exploded perspective view of the locking device of FIG. 1.

Referring to FIGS. 4-6, the locking device 20 includes an operating lever 40 and a generally U-shaped body 42. The operating lever 40 and body 42 are pivotally connected by a pivot pin 44 inserted through aligned bores defined therein, such that the operating lever 40 may pivot relative to the body 42 about an axis generally parallel with the insertion axis 28.

The operating lever 40 has a generally central pivot portion 48. On a first side of the pivot portion 48, the operating lever 40 includes a revolver engagement leg 50. On a second side of the pivot portion 48, the operating lever 40 includes a biasing leg 52 and thumb tab 54.

The revolver engagement leg 50 has a blocking face 58 and a beveled face 60 formed on a lower end thereof. The biasing leg 52 is resiliently displaceable relative to the rest of the operating lever 40. The thumb tab 54 extends generally in parallel with the insertion axis 28 and is dimensioned rearwardly out of the holster pocket 14 (see FIG. 1) to be operable by the user.

The U-shaped body 42 has generally opposed first and second openings 64, 66 defined therein. The first opening 64 accommodates the revolver engagement leg 50 therein. The biasing leg 52 and thumb tab 54 extend out from the second opening 66. The relative dimensions of the operating lever 40 and the body 42 are such that, with the biasing leg 52 in a relaxed state, the blocking and engagement faces 58, 60 of the engagement leg 50 will protrude inwardly from the first opening 64 (as seen in FIG. 4).

The U-shaped body 42 further includes a biasing leg guide 70 and a positioning tab 72 extending outwardly therefrom. The guide 70 helps ensure proper positioning of the biasing leg 52. The positioning tab 72 assists in maintaining a desired standoff distance between the holster pocket 14 (see FIG. 2) and the body 42.

Figure 7:
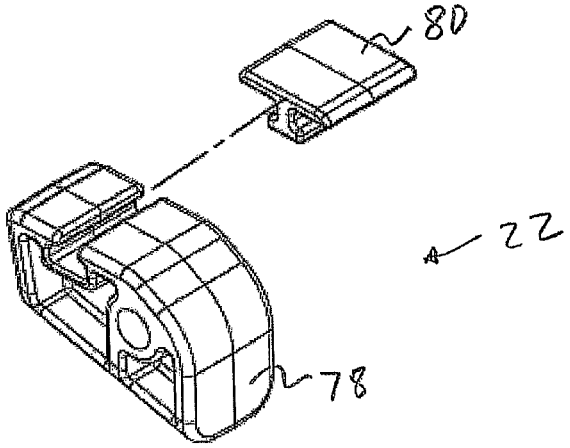
FIG. 7 is an exploded perspective view of the barrel positioning block assembly of FIG. 3.

Referring to FIG. 7, the barrel positioning block assembly 22 includes a base positioning block 78 and at least one adapter insert 80. The block 78 can be used with or without the insert 80, depending on the type of revolver being used with the holster assembly 10.

Figure 8:
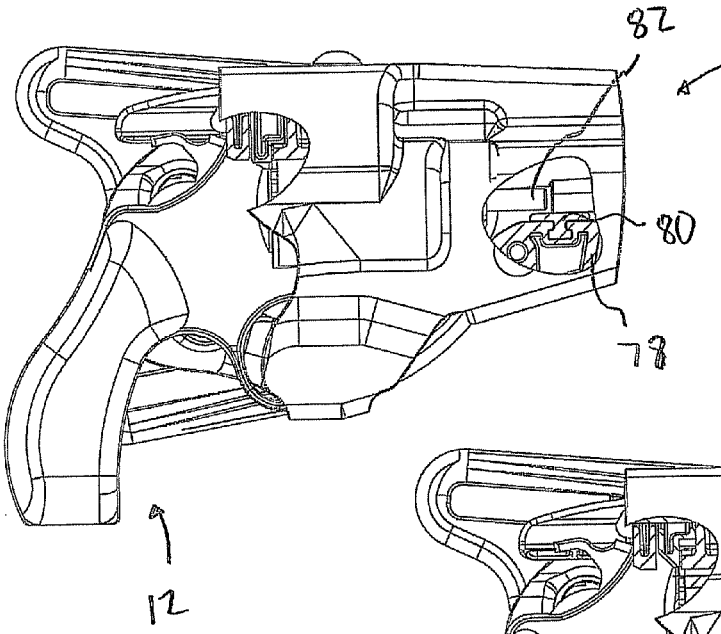
FIG. 8 is a side view of the holster assembly of FIG. 1, with the revolver inserted therein and partially cutaway to show a first configuration of the barrel positioning block assembly.
Figure 9:
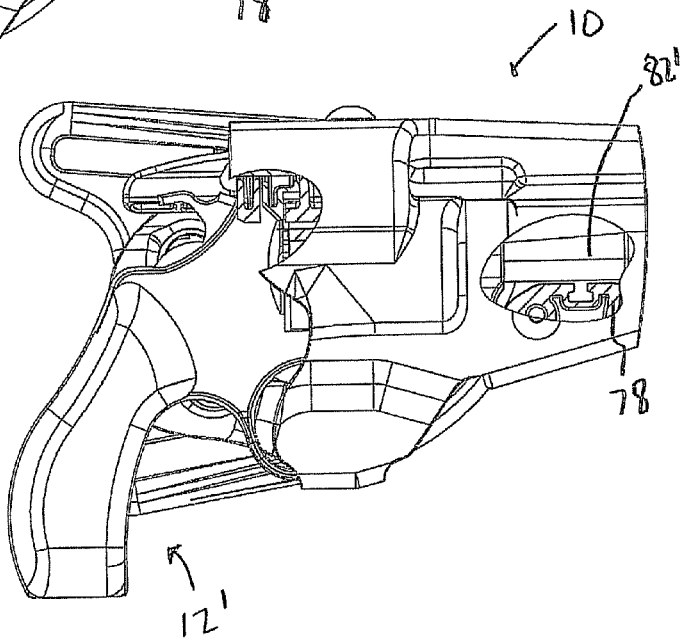
FIG. 9 is a side view of the holster assembly of FIG. 1, with another revolver inserted therein and partially cutaway to show a second configuration of the barrel positioning block assembly.

For example, referring to FIG. 8, the revolver 12 has an unenclosed ejector rod 82. To ensure proper positioning, the base positioning block 78 is used together with the adapter insert 80. Referring to FIG. 9, the revolver 12' has an ejector rod enclosure 82' sufficiently large to use the block 78 without the insert 80.

Figure 10:
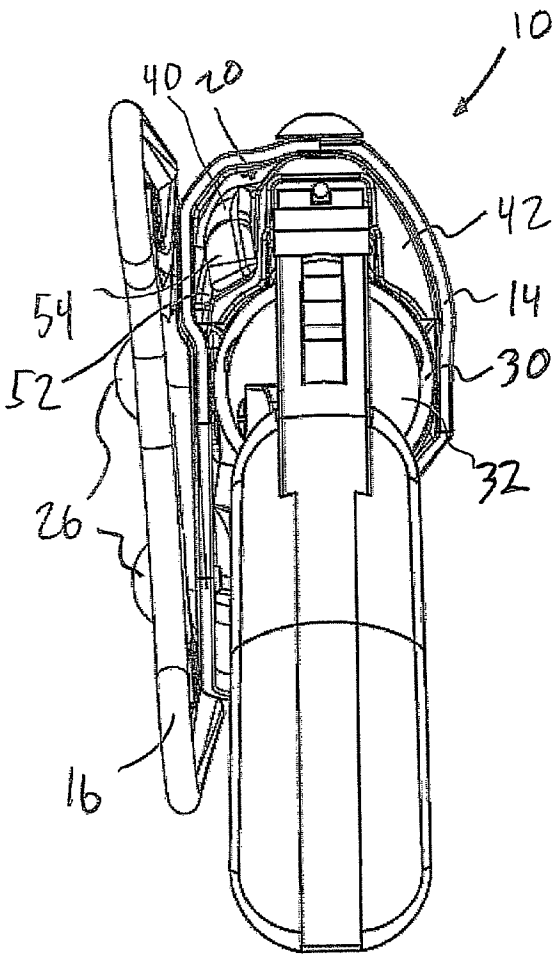
FIG. 10 is a rear view of the holster assembly of FIG. 1, in a unlocked position.

Referring to FIG. 2, during use of the holster assembly 10, the firearm 12 is inserted into the holster pocket 14. During insertion, the leading edge of the cylinder 30 contacts the beveled face 60 of the revolver engagement leg 50, urging the engagement leg 50 outwardly, out of the path of the cylinder 30, and causing the operating lever 40 to pivot, flexing the biasing leg 52 (see FIG. 10).

Figure 11:
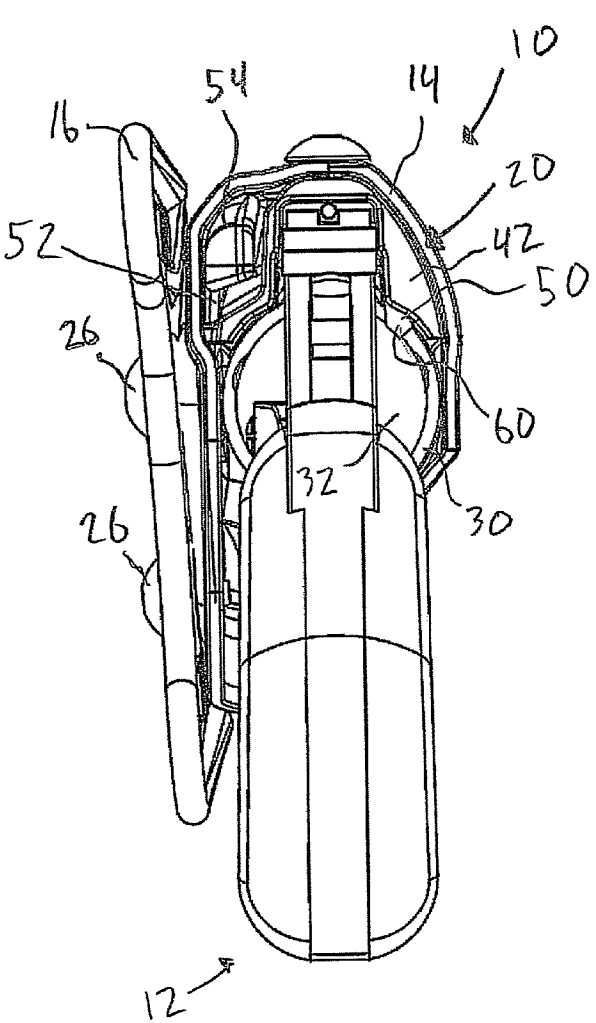
FIG. 11 is a rear view of the holster assembly of FIG. 10, in a locked position.

When the revolver 12 is fully inserted, the cylinder 30 and cylinder guard 32 will clear the engagement leg 50. As a result, the biasing leg 52 will relax and urge the engagement leg 50 inwardly and behind the cylinder 30 and guard 32 (see FIG. 11). Engagement between the cylinder 30 and/or guard 32 with the blocking face 58 of the engagement leg 50 will inhibit withdrawal of the revolver 12.

When withdrawal of the revolver 12 is desired, the user manually depresses the thumb tab 54. As a result, the engagement leg 50 is again pivoted outwardly, out of the path of the cylinder 30 and guard 32, and the biasing leg 52 is flexed (see FIG. 10). The revolver 12 can then be freely withdrawn. Upon subsequent release of the thumb tab 54, the biasing leg 52 will again relax, urging the engagement leg 50 inwardly. The holster assembly 10 is then ready for automatic locking upon reinsertion of the revolver 12.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A holster assembly for a revolver, the holster assembly comprising: a holster pocket for removably accommodating a revolver having a rotating cylinder, the holster pocket generally surrounding an insertion axis of the revolver, the holster pocket having a generally U-shaped body entirely therewithin; and a locking device disposed within the holster pocket for automatically engaging a rear surface of the rotating cylinder of the revolver upon insertion into the holster pocket and selectively operable from outside the pocket to allow subsequent withdrawal of the revolver, the locking device including an operating lever having a pivot portion entirely within the holster pocket and mounted to the U-shaped body entirely within the holster pocket and pivotable about an axis generally parallel with the insertion axis with an outer end portion accessible outwardly of the holster pocket, and a biasing element integral with the operating lever for biasing the operating lever into engagement with the rear surface of the cylinder of the revolver.

2. The holster assembly of claim 1, wherein the pivot portion and the U-shaped body are connected by an elongated pivot pin entirely within the holster pocket and having an axis generally parallel with the insertion axis and inserted through respective aligned bores defined in the pivot portion and the U-shaped body.

3. The holster assembly of claim 1, wherein the biasing element is a resilient leg.

4. The holster assembly of claim 1, wherein the operating lever has a thumb tab protruding out of the holster pocket and selectively operable to move the operating lever out of engagement with the revolver cylinder to permit withdrawal of the revolver by a user.

5. The holster assembly of claim 4, wherein the operating lever has a revolver engagement leg located on a first side of the pivot portion, and the biasing element and the thumb tab being located on a second side of the pivot portion.

6. The holster assembly of claim 5, wherein the revolver engagement leg has a beveled face and a blocking face, the faces being arranged such that the revolver contacts the beveled face during insertion and the blocking face impedes withdrawal of the revolver when fully inserted until moved out of engagement with the cylinder.

7. The holster assembly of claim 6, wherein the U-shaped body defines a first opening on one side thereof into which the beveled and blocking faces of the leg are retracted when moved outwardly away from the revolver.

8. The holster assembly of claim 7, wherein the U-shaped body defines a second opening on another side thereof through which the operating lever and biasing element extend.

9. The holster assembly of claim 8, wherein the U-shaped body includes a positioning tab extending laterally outwardly therefrom to engage the holster pocket and maintain a desired spacing between the holster pocket and the U-shaped body.

10. The holster assembly of claim 8, wherein the biasing element is a biasing leg and the U-shaped body further includes a biasing guide extending laterally outwardly therefrom to facilitate proper positioning of the biasing leg outside the second opening.

11. The holster assembly of claim 8, wherein the relative dimensions of the operating lever and the U-shaped body are such that, with the biasing element in a relaxed state, the beveled and blocking faces will protrude inwardly from the first opening.

12. The holster assembly of claim 11, wherein the beveled and blocking faces will protrude inwardly from the first opening behind at least one of the cylinder and its cylinder guard of the revolver.

13. The holster assembly of claim 1, further comprising a barrel positioning block assembly secured spacedly upward from a lower end of the holster pocket to engaging a trigger guard of a revolver and to limit insertion of the revolver into the holster pocket, without any portion of the block assembly extending into and/or engaging an open free end of a barrel of the revolver, and facilitate proper alignment between the revolver and the U-shaped body and the locking device.

14. The holster assembly of claim 13, wherein the barrel positioning block includes a base positioning block releasably fastened to the holster pocket and an adapter insert removably secured to the base positioning block to allow accommodation for varying revolver dimensions.

15. The holster assembly of claim 1, further comprising a belt attachment plate secured to the holster pocket adjacent the operating lever and facilitating wearing of the holster assembly by a user.

16. A holster assembly for a revolver, the holster assembly comprising: a holster pocket for removably accommodating a revolver having a rotating cylinder and cylinder guard, the holster pocket generally surrounding an insertion axis of the revolver; and a locking device arranged in the holster pocket for automatically engaging the revolver upon insertion into the holster pocket and selectively operable from outside the pocket to allow subsequent removal of the revolver, the locking device being configured to automatically engage at least one of a rear surface of the cylinder and a rear surface of the cylinder guard of the revolver; the locking device further comprising an elongated operating lever with a pivot portion entirely within the holster pocket, and an end portion extending out of an upper open end of the pocket for engagement by a thumb of a user in withdrawing the revolver from the pocket.

17. A holster assembly for a revolver, the holster assembly comprising:

a holster pocket for removably accommodating a revolver having a rotating cylinder and cylinder guard, the holster pocket generally surrounding an insertion axis of the revolver; and a locking device arranged in the holster pocket for automatically engaging the revolver upon insertion into the holster pocket and selectively operable to allow subsequent withdrawal of the revolver, the locking device including a generally U-shaped body entirely within the holster pocket and having first and second openings defined on generally opposite sides thereof, and an operating lever having a pivot portion entirely within the holster pocket and mounted to the U-shaped body and pivotable about an axis generally parallel with the insertion axis, a revolver engagement leg extending from a first side of the pivot portion and retractable into the first opening, a resilient biasing leg extending from a second side of the pivot portion and biasing the revolver engagement leg into engagement with at least one of a rear surface of the cylinder of the revolver and a rear surface of the cylinder guard, and a thumb tab extending from the second side of the pivot portion and protruding out of the holster pocket, the thumb tab being operable to pivot the revolver engagement leg into the first opening and out of engagement with the revolver to permit withdrawal of the revolver by a user.

18. The holster assembly of claim 17, wherein the U-shaped body further includes:

a biasing guide extending outwardly therefrom to facilitate proper positioning of the biasing leg outside the second opening; and a positioning tab extending outwardly therefrom to maintain a desired spacing between the holster pocket and the U-shaped body.

19. The holster assembly of claim 17, wherein the revolver engagement leg has a beveled face and a blocking face, the faces being arranged such that the revolver contacts the beveled face during insertion and the blocking face impedes withdrawal of the revolver when fully inserted until moved out of engagement with the cylinder.

20. The holster assembly of claim 17, further comprising a barrel positioning block assembly secured spacedly upward from a lower end of the holster pocket to limit insertion of the revolver into the holster pocket, without any part of the block assembly extending into an open free end of a barrel of the revolver, and facilitate proper alignment between the revolver, the U-shaped body and the locking device, the barrel positioning block including a base positioning block releasably fastened to the holster pocket and an adapter insert removably secured to the base positioning block to allow accommodation for varying revolver dimensions.

* * * * *